US005984112A

United States Patent [19]

Adams

[11] Patent Number: 5,984,112

[45] Date of Patent: Nov. 16, 1999

[54] DISPLAY APPARATUS

[75] Inventor: Gregory L. Adams, Romeo, Mich.

[73] Assignee: 4th Dimension Engineering, Inc., Shelby Township, Mich.

[21] Appl. No.: 08/871,291

[22] Filed: Jun. 9, 1997

[51] Int. Cl.[6] ..... A47F 7/00

[52] U.S. Cl. ..... 211/14; D6/552

[58] Field of Search ..... 211/14; D6/552; 414/788, 786; 206/315.9, 499

[56] References Cited

U.S. PATENT DOCUMENTS

| | | | |
|---|---|---|---|
| D. 71,133 | 9/1926 | Carrm | 211/14 X |
| 1,201,441 | 10/1916 | Clinger . | |
| 1,595,449 | 8/1926 | Carrm | 211/14 X |
| 2,083,973 | 6/1937 | Zimmerman . | |
| 3,198,338 | 8/1965 | McCormick . | |
| 4,103,773 | 8/1978 | Haber . | |
| 4,212,684 | 7/1980 | Galowitz | 211/14 X |
| 4,561,547 | 12/1985 | Estwanik . | |
| 4,892,197 | 1/1990 | Slattery et al. . | |
| 5,381,895 | 1/1995 | Thomsen | 211/14 X |
| 5,551,832 | 9/1996 | Kelly | 211/14 X |
| 5,695,312 | 12/1997 | Kelly | 211/14 X |
| 5,715,947 | 2/1998 | Gonzales | 211/14 |
| 5,746,332 | 5/1998 | Kleinschmidt | 211/14 X |

*Primary Examiner*—Daniel P. Stodola
*Assistant Examiner*—Khoa Tran
*Attorney, Agent, or Firm*—Brooks & Kushman P.C.

[57] ABSTRACT

A golf ball holder for displaying golf balls. The golf ball holder is manufactured from a thermoplas tic material. The holder is manufactured to accommodate from a single golf ball to an infinite number. A base portion supports the holder and the golf ball holder terminates in a top portion that seats a single golf ball. A side display portion extends from the base portion to the top portion and has a plurality of openings formed therein for receiving and retaining golf balls therein.

9 Claims, 1 Drawing Sheet

DISPLAY APPARATUS

TECHNICAL FIELD

The present invention relates to an apparatus for holding and displaying items. More specifically, the present invention relates to an apparatus for displaying golf balls.

BACKGROUND ART

Various types of display devices are known in the art. Examples of some display devices are disclosed in U.S. Pat. Nos. 1,201,441; 2,083,973; 3,198,338; 4,103,773; 4,561,547; 4,892,197; and 5,381,895. The prior art displays suffer from various disadvantages.

For example, some prior apparatus for displaying items have elongated rectangular bases that are unstable. Further, these prior apparatus require the use of a large amount of material to form the display and they are therefore relatively expensive. These apparatus are also configured such that they encompass a large portion of each of the items making it difficult for all of the items to be seen. It is also difficult for the displayed items to be easily moved and maneuvered from one location on the display to another.

This is particularly, true with respect to prior display apparatus for golf balls. These prior golf ball holders or displays require a large amount of material and are relatively expensive. Further, these prior display apparatus are configured such that they—encompass large portions of the golf balls placed therein and thus cover any logo thereon. These prior golf ball display apparatus also do not allow for easy rearrangement of the golf balls or easy addition or subtraction.

SUMMARY OF THE INVENTION

It is an object of the present invention to provide a display apparatus that is more stable than prior apparatus and requires much less material to manufacture.

It is another object of the present invention to provide a display apparatus that has very little surface area contacting the golf ball, but still fully supports the golf ball and allows for easy manipulation of the golf balls within the display.

It is yet another object of the present invention to provide a display apparatus for holding logo golf balls that allows for easy visibility of the logos on the golf balls supported on the display.

The present invention provides a golf ball holder for displaying a plurality of golf balls, including, a generally circular, triangular, or square base portion for supporting the golf ball holder. The golf ball holder includes a top portion having a seat portion for receiving a golf ball in the seat portion. An integrally molded display portion extends generally upward and generally inward from the base portion to the top portion such that the distance around the periphery of the base portion is greater than the distance around the periphery of the top portion. A plurality of openings are formed in the display portion with each of the openings adapted to receive a golf ball. The openings are formed such that their radius is approximately equal to the radius of the back portions of each of the golf balls.

Additional features and advantages of the present invention will become apparent to one of skill in the art upon consideration of the following detailed description of the present invention.

BEST MODE FOR CARRYING OUT THE INVENTION

Recently, golfers have begun collecting golf balls bearing the logos of famous golf courses or courses that the golfer has played or even seen on television. Business also distribute collector golf balls with their company name or logo printed on the golf ball's surface. Golfers collect these logo golf balls as a reminder of the courses that they have played or as a souvenir from other famous courses. The golfer typically displays these logo golf balls at his home or place of business for viewing or as a centerpiece for viewing by others and for discussion.

Figure 1:
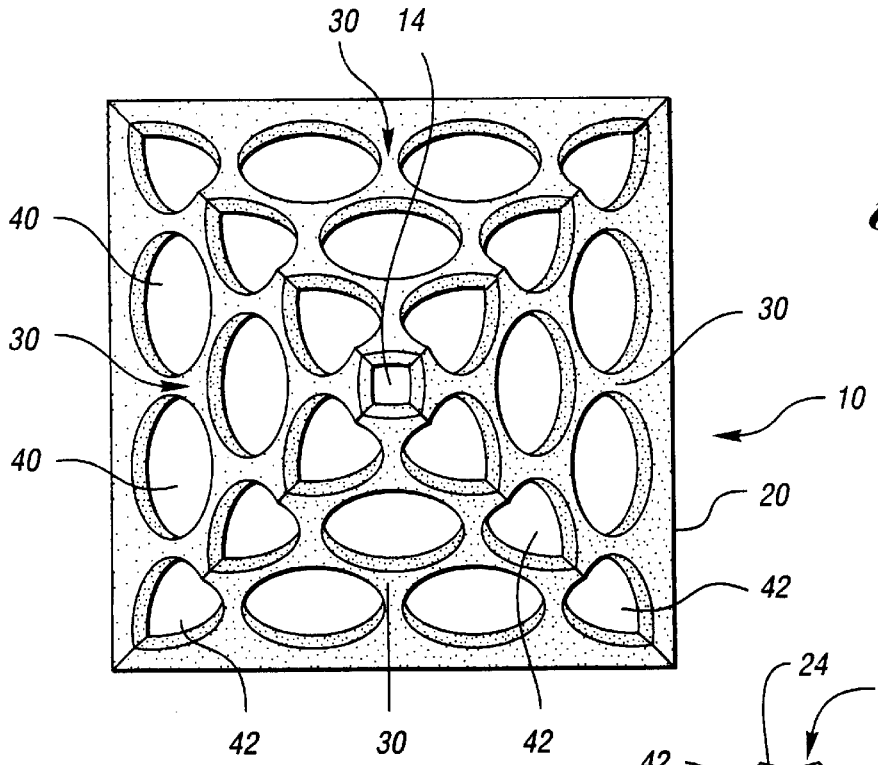
FIG. 1 is top view of the golf ball holder in accordance with a preferred embodiment of the present invention.
Figure 2:
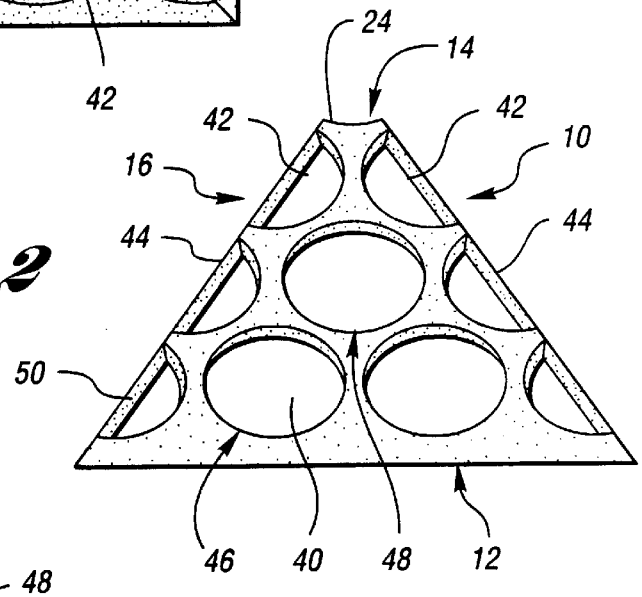
FIG. 2 is a side view of the golf ball holder in accordance with a preferred embodiment of the present invention.
Figure 3:
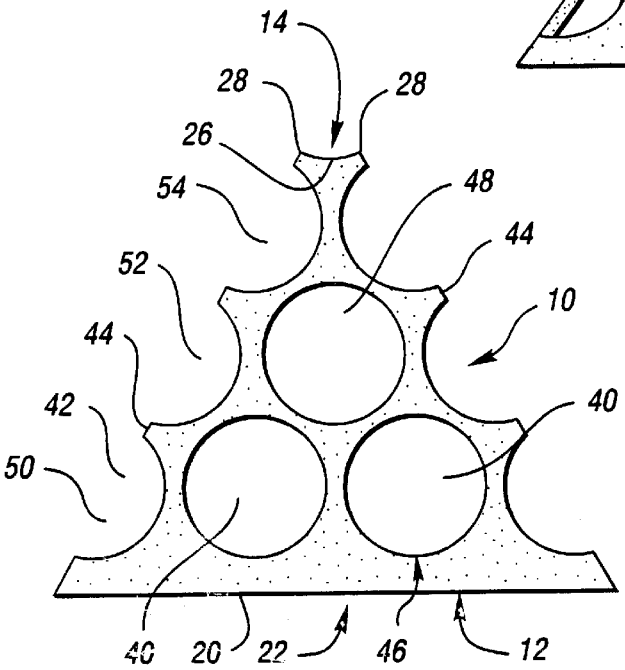
FIG. 3 is a side view of a generally planar side portion of the golf ball holder in accordance with a preferred embodiment of the present invention.

FIGS. 1 through 3 illustrate a preferred golf ball holder 10 in accordance with the present invention. The golf ball holder is preferably manufactured from a polycarbonate material. However, the holder can be manufactured from any thermoplastic material such as ABS, styrene, or polypropylene. Further, the disclosed holder can also be manufactured from various other materials, including, wood, brass, steel, cardboard, and styrofoam. Further, while the golf ball holder 10 is preferably transparent, it can also be manufactured in any different color as well as a plurality of colors.

While FIGS. 1 through 3 illustrate a golf ball holder, it should be understood that the holder is not solely limited to holding and displaying golf balls. In accordance with the teachings of the present invention, a light weight, inexpensive, highly visible holder can be manufactured for holding and displaying various other items, including, bowling balls, fruits and vegetables, eggs at Easter, pool balls, and business cards. Alternatively, the holder can be used as a lazy susan base.

The preferred golf ball holder 10 is an integrally formed one piece unit having a base portion 12, a top portion 14, and a display portion 16. The base portion 12 is generally planar in that it is designed to rest on a generally flat surface, such as a table or the ground. The base portion 12 has a peripheral portion 20 that contacts the generally flat surface, such as a table or ground, to support the golf ball holder 10. The base portion 12 also includes a hollow portion 22 that is bounded at its bottom by the peripheral portion 20. As shown in FIGS. 1 through 3, the base portion 12 is square. However, the shape of the base portion may vary. For example, the base portion 12 can shaped in a variety of different ways, including triangular, ovular, rectangular, and circular.

The top portion 14 is located above the base portion 12 and is oriented generally parallel to the base portion 12 and the generally flat surface which the base portion 12 contacts. The top portion 14 preferably includes a seat portion 24 that is designed to support and retain a golf ball (not shown). The seat portion 24 has a generally arcuate surface 26 that contacts the golf ball. The arcuate surface 26 has two end portions 28 that extend generally upward. The arcuate surface 26 preferably has a radius of 0.825 inches. Alternatively, depending upon the shape of the base portion 12, the seat portion 24 need not have any arcuate surfaces and can include a circular seat, a square seat, or a triangular seat for housing the golf ball. The opening in the top portion 14 need only have an opening that is sized to support and retain a golf ball therein and retain it such that about 75% of the golf ball sits above the top portion 14.

The display portion 16 extends generally upwardly and inwardly from the base portion 12 to the top portion 14. As shown in FIG. 1 through 3, the display portion 16 includes four generally planar sides 30 such that the base portion 12 is square and the holder 10 is pyramidal in shape. In an alternative embodiment, the display portion 16 has three generally planar sides 30, such that the base portion 12 is triangular and the holder 10 is pyramidal in shape. In yet another alternative embodiment, the display portion 16 includes a single surface that extends from the base portion 12 to the top portion 14. In this embodiment, —the base portion 12 is circular in shape and the holder 10 is conical in shape. It is obvious that the holder 10 can take the form of other shapes, including a sphere, a trapezoid, and a hexagon.

The display portion 16 also has a plurality of openings 40 formed in its sides 30 for receiving golf balls therein. The display portion 16 also has a plurality of corner openings 42 formed at the junction 44 where each of the planar sides 30 meet. In the embodiment, shown in FIGS. 1 through 3, twenty five total golf balls can be displayed. A single golf ball can be placed into the seat portion 24. Three golf balls can be placed on each of the four generally planar sides 30. The golf balls are arranged such that two fit in the two openings 40 that are positioned on each of the first rows 46. Further, a single golf ball is retained in a single opening that is positioned on each of the second rows 48 on each of the generally planar sides 30. Thus, twelve golf balls total can be placed on the generally planar sides 30.

Three openings 42 are positioned along the junctions 44 where two generally planar sides 30 meet. The bottom opening 50 is aligned with the first row 46 of openings on the generally planar sides 30, the second opening 52 is aligned with the second row 48 of openings, and the third opening 54 is positioned above the second row 48 of openings. Thus, another twelve golf balls can be held at the four junctions 44 for a total twenty-five golf balls in the display. In the preferred embodiment, with two rows 46, 48, the base portion 12 has a length of 6 5/16 inches.

It should be understood that the number of rows can be varied from zero to an infinite number. The only constraint is the size of the molding machine used to manufacture these parts. It should also be understood that the geometry of the rows on the holder will also change proportionally as the number of total openings on the display increases or decreases. Thus, if the display is intended to house only one ball, no rows will be present, only the seat portion 24 on the top portion 14. The length and width of the display will change proportionally based on the number of rows in the holder 10.

The angle of the planar sides 30 as they extend from the base portion 12 to the top portion 14 can vary between 0 and 90 degrees. However, it is preferably, around 54¾ degrees. Further, the size of the openings 40, 42 may also vary. But in order to expose as much of the golf ball as possible for good visibility as well as to retain it in the holder 10 to prevent it from coming dislodged, the diameter of the openings 40 on the generally planar sides 30 is preferably between 1.0 and 1.8 inches. However, depending upon the angle of the planar sides 30, the diameter may be changed. Further, the radius of the openings 42 at the junctions 44 of the sides 30 is preferably between 0.8 and 0.9 inches. The radius of a typical golf ball is 0.840 inches, thus approximately 80% of the golf ball is retained outside the holder 10 for viewing. Further, the configuration of the display allows a user to remove any single ball without disturbing the other balls positioned in the holder 10. The golf balls 10 can thus be rearranged or removed easily.

In an embodiment, housing 25 golf balls, the thickness of the material is preferably 0.120 inches. This represents a significant reduction in material and cost over prior display apparatus.

The hollow portion 22 in the base portion 12 allows a plurality of holder 10 to be nested upon one another. The holders 10 can thus be nested to conserve space while shipping. This also provides the additional advantage that less retail space will be needed to display the disclosed golf ball holders. In a nested relationship, the outer surface of the planar surface 30 of the bottom holder 10 would contact the inner surfaces of the planar surface 30 of the top holder 10.

In an alternative embodiment, not shown, the golf ball holder 10 includes a single planar side 10 that is positioned like a picture frame. The single planar face 10 also has a plurality of openings to support and retain a plurality of golf balls therein. In this embodiment, the single planar face 30 is preferably rectangular of square, but may take on other shapes. The base portion is preferably omitted, but instead a single generally vertical support is attached to the underside of the single planar face 30 to provide the necessary support.

While only one preferred embodiment of the invention has been described hereinabove, those of ordinary skill in the art will recognize that this embodiment may be modified and altered without departing from the central spirit and scope of the invention. Thus, the embodiment described hereinabove is to be considered in all respects as illustrative and not restrictive, the scope of the invention being indicated by the appended claims, rather than by the foregoing descriptions, and all changes which come within the meaning and range of equivalency of the claims are intended to be embraced herein.

What is claimed is:

1. A golf ball holder for displaying a plurality of golf balls, comprising:

a base portion for resting on a generally flat surface;

a top portion having a seat for receiving one of the plurality of golf balls;

a plurality of generally planar sides extending generally upward and generally inward from the base portion to said top portion such that the seat is located generally over the center point of the base portion with a hollow interior;

a plurality of planar side openings formed in the planar sides, each of the side openings communicating to the hollow interior and including an open periphery sized to receive and retain one of the plurality of golf balls; and a plurality of corner openings formed at a point where an adjacent pair of the plurality of generally planar sides meet, each of the corner openings also communicating to the hollow interior and including an open periphery which is sized to receive and retain one of the plurality of golf balls.

2. The golf ball holder of claim 1, wherein the golf ball holder includes four generally planar sides and is generally pyramidal in shape.

3. The golf ball holder of claim 2, wherein said base portion has the shape of a square.

4. The golf ball holder of claim 3, wherein the angle of the planar sides as they extend from the base portion to the top portion is around 54¾ degrees.

5. The golf ball holder of claim 1, wherein said plurality of planar side openings are each 1.00 to 1.80 inches in diameter.

6. The golf ball holder of claim 5, wherein said plurality of corner openings are between 0.8 and 0.9 inches in diameter.

7. A golf ball holder for displaying a plurality of golf balls, comprising:

a base portion;

a top portion having a seat portion for receiving one of the plurality of golf ball in the seat portion;

an integrally molded display portion extending generally upward and generally inward from the base portion to the top portion such that the distance around the periphery of the base portion is greater than the distance around the periphery of the top portion and with a hollow interior;

a plurality of openings into the hollow interior formed in the display portion, each of the openings including an open periphery adapted to receive and support one of the plurality of golf ball;

whereby each of the open peripheries is formed such that its radius is approximately equal to the radius of the back quarter portion of the golf ball to be received and supported thereby so that when the golf ball is received and supported by the open periphery it is supported by no other structure.

8. The golf ball holder of claim 7, wherein said base portion is generally square.

9. The golf ball holder of claim 8, wherein said display portion, includes a plurality of generally planar sides and wherein the golf ball holder is pyramidal in shape.

* * * * *